US008408426B2

(12) United States Patent
Bakhos

(10) Patent No.: US 8,408,426 B2
(45) Date of Patent: Apr. 2, 2013

(54) SQUEEZABLE PARTITION BOTTLE AND BAG ASSEMBLY

(76) Inventor: Joseph Wadih Bakhos, Sugarloaf, CA (US)

( * ) Notice: Subject to any disclaimer, the term of this patent is extended or adjusted under 35 U.S.C. 154(b) by 0 days.

(21) Appl. No.: 13/330,484

(22) Filed: Dec. 19, 2011

(65) Prior Publication Data

US 2012/0111894 A1 May 10, 2012

Related U.S. Application Data

(63) Continuation-in-part of application No. 12/110,370, filed on Apr. 28, 2008, now abandoned.

(60) Provisional application No. 61/068,442, filed on Mar. 7, 2008.

(51) Int. Cl.
*B65D 37/00* (2006.01)

(52) U.S. Cl. ..... 222/209; 222/212; 222/386.5; 222/105

(58) Field of Classification Search ..... 222/105, 222/209, 212–215, 94, 386, 386.5, 92, 95; 215/12.1, 902
See application file for complete search history.

(56) References Cited

U.S. PATENT DOCUMENTS

| | | | | |
|---|---|---|---|---|
| 1,854,458 | A | | 4/1932 | De Quincy et al. |
| 3,296,803 | A | | 1/1967 | Kroekel |
| 3,319,837 | A | | 5/1967 | Mueller |
| 3,417,901 | A | | 12/1968 | Sands |
| 3,592,365 | A | | 7/1971 | Schwartzman |
| 3,819,092 | A | | 6/1974 | Bonduris |
| 4,154,366 | A | | 5/1979 | Acres |
| 4,193,513 | A | * | 3/1980 | Bull, Jr. ..... 222/1 |
| 4,239,132 | A | | 12/1980 | Mueller et al. |
| 4,760,937 | A | | 8/1988 | Evezich |
| 4,842,165 | A | | 6/1989 | Van Coney |
| 5,238,150 | A | * | 8/1993 | Williams ..... 222/95 |
| 5,332,121 | A | | 7/1994 | Schmidt et al. |
| 5,487,490 | A | | 1/1996 | Estes |
| 5,687,882 | A | | 11/1997 | Mueller |
| 6,364,163 | B1 | | 4/2002 | Mueller |
| 2009/0224002 | A1 | | 9/2009 | Bakhos |

* cited by examiner

*Primary Examiner* — Kevin P Shaver
*Assistant Examiner* — Robert Nichols, II
(74) *Attorney, Agent, or Firm* — Knobbe Martens Olson & Bear, LLP

(57) ABSTRACT

A squeeze bottle forces substantially all of the liquid to be dispensed toward a top of the bottle. A valving arrangement reduces or eliminates a likelihood of air contacting the liquid to be dispensed. A top cap has a nozzle with a one-way valve allowing liquid to leave a liquid bag. A bottom cap has a one-way valve allowing air to enter an airbag. The liquid bag and the airbag are positioned within a sealed third chamber. The liquid bag and the airbag have a controlled interaction within the sealed third chamber, which results in substantially complete emptying of the liquid bag by squeezing the bottle.

20 Claims, 9 Drawing Sheets

SQUEEZABLE PARTITION BOTTLE AND BAG ASSEMBLY

RELATED APPLICATIONS

This application is a continuation-in-part of U.S. patent application Ser. No. 12/110,370, filed Apr. 28, 2008, which claims priority from U.S. Provisional Application No. 61/068,442, filed on Mar. 7, 2008, each of which is hereby incorporated by reference in its entirety.

BACKGROUND OF THE INVENTION

1. Field of the Invention

This invention relates to a squeezable container that forces the liquid to be dispensed toward the top of the container. The container also reduces or eliminates the likelihood of exposure of the liquid in the container to air.

2. Related Art

Most squeeze bottles necessarily allow air into the bottle as the liquid is dispensed out of the bottle. This exposes the liquid to contamination. When exposed to air, some liquids can cure (glue, for example), causing the nozzle of the container to become clogged. Also, whether because of contamination or curing, the shelf life of the liquid is reduced by the entry of air to mix with it. One additional problem is that once the bottle is set upon its base, the liquid falls to the bottom of the bottle. With some thick liquids, this means that the bottle must be shaken to get the liquid to the nozzle before the liquid is dispensed again. Lastly, the liquid clinging to the sides of the bottle is unsightly. For this reason, most squeeze bottles are made of some sort of opaque plastic.

U.S. Pat. No. 4,239,132 uses two one-way valves and an air bladder to try to force the liquid out of the bottle. This design creates two airtight chambers within the bottle. The problem with this design is that liquid can be trapped far away from the nozzle. The liquid becomes trapped because there is no control over how the air bladder inflates. The air bladder will often inflate in a way that traps some of the liquid far away from the nozzle. Then the trapped liquid can no longer be dispensed.

U.S. Pat. No. 4,760,937 is similar to the previous cited patent. The patent discloses a configuration that employs two one-way valves and also divides the interior of the bottle into two chambers. The difference is that U.S. Pat. No. 4,760,937 puts the liquid into a bag. The air entering the rear chamber still displaces the liquid. The problem with this design is that there is no control over the way in which the bag containing the liquid will compress. Often the bag will compress in a way that blocks the nozzle and then prohibits all of the liquid from being dispensed.

U.S. Pat. Nos. 5,687,882 and 6,364,163 are similar to U.S. Pat. No. 4,239,132 in that they disclose configurations that employ one-way valves and an air bladder to displace the liquid. They are different in that they both employ a column attached to a sliding collar (sometimes with a piston) in order to try to control the deployment of the air bladder. Both of these inventions also divide the interior of the bottle into two chambers. There are a few problems with these inventions. The first problem is that when the bottle is squeezed the bladder will not neatly deploy as envisioned. Sometimes, a bubble of liquid will force itself behind the piston or collar; this bubble of liquid will end up being trapped remote from the nozzle. The bubbling and trapping issue seen in all prior inventions is intrinsic to any design where the interior of the bottle is divided topologically into only two chambers. In any two-chambered design there arises a contradiction: if the plunger is made too tight, then too much force is required to move it; and, if the plunger is made too loose (or if the plunger is flexible, or if there is no plunger) then some liquid will bubble through to the other side during operation. An additional problem with U.S. Pat. Nos. 5,687,882 and 6,364,163 are their complexity: the costs of producing these bottles and packaging liquid in them are prohibitive.

SUMMARY OF THE INVENTION

An object of certain configurations of the present invention is to provide a container that alleviates at least some of the drawbacks discussed in regards to the existing configurations. This new type of bottle can be inexpensive to manufacture and package. This bottle can reduce or eliminate the likelihood of outside air contacting the packaged liquid during dispensing. This can increase shelf life and sanitation as well as eliminating the problems associated with air-cured liquids, such as clogged nozzles. This bottle can also be easy to use; it may not be necessary to shake the bottle or to store the bottle upside-down in order to use it. This bottle also is preferably aesthetically pleasing; substantially all of the liquid can be packaged in a clear container where the liquid is generally forced to the top of the container.

Some embodiments can have a top cap having a nozzle with a one-way valve that allows liquid to leave the container. This top may be removably attached to the container. Some embodiments can have a bottom cap that has a one-way valve. This bottom cap can be removably attached to the body of the container. In some embodiments, the containers can have three chambers.

Chamber one can be a bag containing the liquid. Preferably, this bag is airtight with no ingress. The only egress can be the one-way valve at the top where the liquid can escape. The top cap can press the lip of the liquid bag between the top cap and the body of the container, creating an airtight seal.

Chamber two can be a bag containing the air. Preferably, this bag is airtight with no egress. The only ingress can be the one-way valve in the bottom cap. The bottom cap can press the lip of the airbag between the bottom cap and the body of the container.

Chamber three can be a generally sealed chamber that is within the bottle but not within either bag. Preferably, this chamber has no egress or ingress. Both bags and the seals at each end of the bottle can create this chamber.

According to at least one embodiment of the invention, there may be a plunger between the bags to ensure that the two separate bags do not become entangled.

According to at least one embodiment of the invention, there may be one single bag that is molded of one piece that has two separate chambers.

According to at least one embodiment of the invention, there may be one single molded part that is essentially a single bag with two chambers along with a plunger between the two chambers.

DETAILED DESCRIPTION OF THE PREFERRED EMBODIMENTS OF THE INVENTION

In this application, numbers in parenthesis refer to notes on the drawings. Any given number will refer to the same part on all drawings, figures, and embodiments. For example, the number (6) refers to an upper one-way valve on all of the drawings and figures and embodiments. The drawings are not actual size.

Certain features, aspects and advantages of the present invention relate to a squeeze bottle that forces substantially all of the liquid to be dispensed toward the top of the bottle. Certain features, aspects and advantages of the present invention reduce or eliminate the likelihood of air contacting the liquid to be dispensed. The bottle can be composed of the following: a top cap having a nozzle with a one-way valve that allows liquid to leave the container and a bottom cap having a one-way valve that allows air to enter an airbag. The caps can couple to a body of the bottle. The body preferably is squeezable, such that the liquid can be displaced by squeezing the body. The liquid can be in a bag that is referred to as a first chamber. This first chamber preferably is airtight with the only egress for the liquid being through the top one-way valve. The bottom chamber can be an airbag that is distinct from the liquid bag. This second bag can form a distinct second chamber that also is airtight. The second chamber can communicate exclusively to the outside air, thereby only allowing air in through the one-way valve at the bottom. The arrangements of the body of the bottle and the two bags can create a third chamber, sometimes called the vacuum chamber, which can also be airtight and which can be sealed from the other chambers and the outside air. The third chamber preferably extends the full length of the first and second chambers such that the third chamber generally extends along or generally encircles the full extent of the first and second chambers. As used herein, chamber has its ordinary meaning and also means an enclosed space. In the illustrated configurations, two of the chambers are sealed with only one opening while the third chamber is fully sealed during use.

Figure 1:
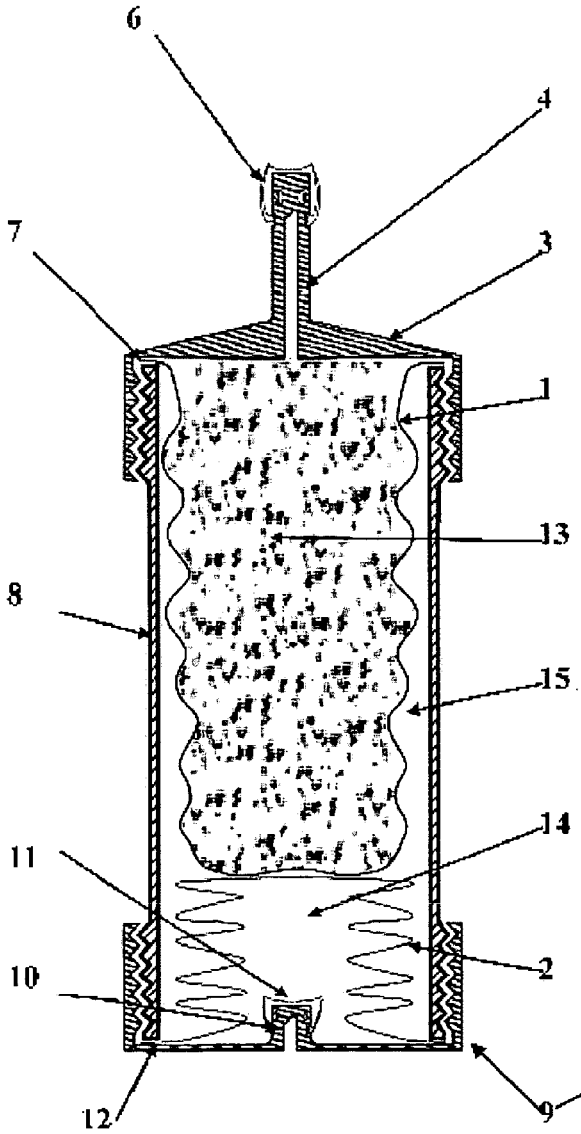
FIG. 1 shows an embodiment employing two bags before squeezing.

FIG. 1 shows an embodiment with two separate distinct bags (1 and 2) without any sort of plunger between them. The illustrated bottle comprises a top cap (3) that has a nozzle (4), wherein there is a one-way valve (6) for the egress of liquid. Preferably, the one-way valve (6) will reduce or eliminate the likelihood of air entering through the one-way valve (6). A top bag (7) can contain liquid to be dispensed. A lip of this top bag (7) can be held in a substantially airtight seal by the pressure of the cap (3) upon the body of the bottle (8). Thus, air generally does not leak between the body of the bottle (8) and the top bag (7). When the bottle (8) is squeezed, liquid is forced out through the top one-way valve (6). There can also be a bottom cap (9) that has a shorter nozzle (10) that is directed inward, wherein there is a one-way valve (11) that allows the ingress of air into the other airbag (2). This one-way valve (11) can allow air into the airbag (2), but generally will not allow air to escape from the airbag (2). The lip (12) of the airbag (2) can be held in a substantially airtight seal by the pressure of the bottom cap (9) upon the body of the bottle (8). The seals at the ends of the bottle, the body of the bottle, and the two bags, can all combine to create three different chambers in the bottle: the liquid bag (1) creates the liquid chamber (13); the airbag (2) creates the air chamber (14); and the sides of the bottle create a third chamber (15) between the sides and the two bags.

Figure 2:
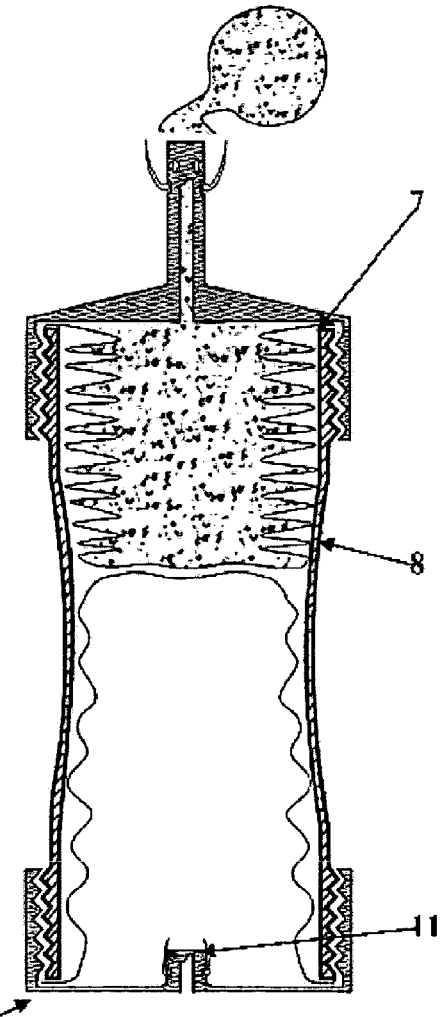
FIG. 2 shows the same embodiment being squeezed after some of the liquid has been dispensed.

FIG. 2 shows the bottle being squeezed. Preferably, the bottle comprises a flexible wall at least in the region of the bags (1, 2). As used herein, flexible has its ordinary meaning and also means able to elastically deform inwardly and repeatedly in a temporary shape change that is self-reversing after the force causing the deformation is reduced or removed. When the bottle is squeezed, liquid is forced out through the one-way valve at the top (6). While it is being squeezed, the bottom air valve (11) is forced shut, not allowing any air to escape. When the bottle is released, the body of the bottle can snap back to its original shape, creating a vacuum inside the bottle. In some configurations, the body of the bottle is plastic. This vacuum within the bottle created when the body returns to its original shape can cause air to enter through the one-way valve at the bottom (11), thereby filling the airbag (2).

Unexpectedly, it has been found that the size, shape, material and/or thickness of the bag or bags (1, 2) can be significant to the proper functioning of the bottle. The air that fills the air chamber (14) is compressible and, when the bottle is squeezed, the bottle compresses inward until it contacts either the airbag (2), the liquid bag (1) or both. Direct contact on the liquid bag (1) causes liquid to be dispensed due to lower compressibility of the liquid; however, direct contact with the airbag (2) causes the airbag (2) to expand against the liquid bag (1), which causes the liquid to be dispensed or causes compression of the air. The increased pressure inside the air chamber (14) when the airbag (2) is compressed pushes the walls of the airbag (2) outward against the walls of the body of the bottle (8) and causes movements of the airbag (2) and the upper bag (1) that results in dispensing.

Figure 3:
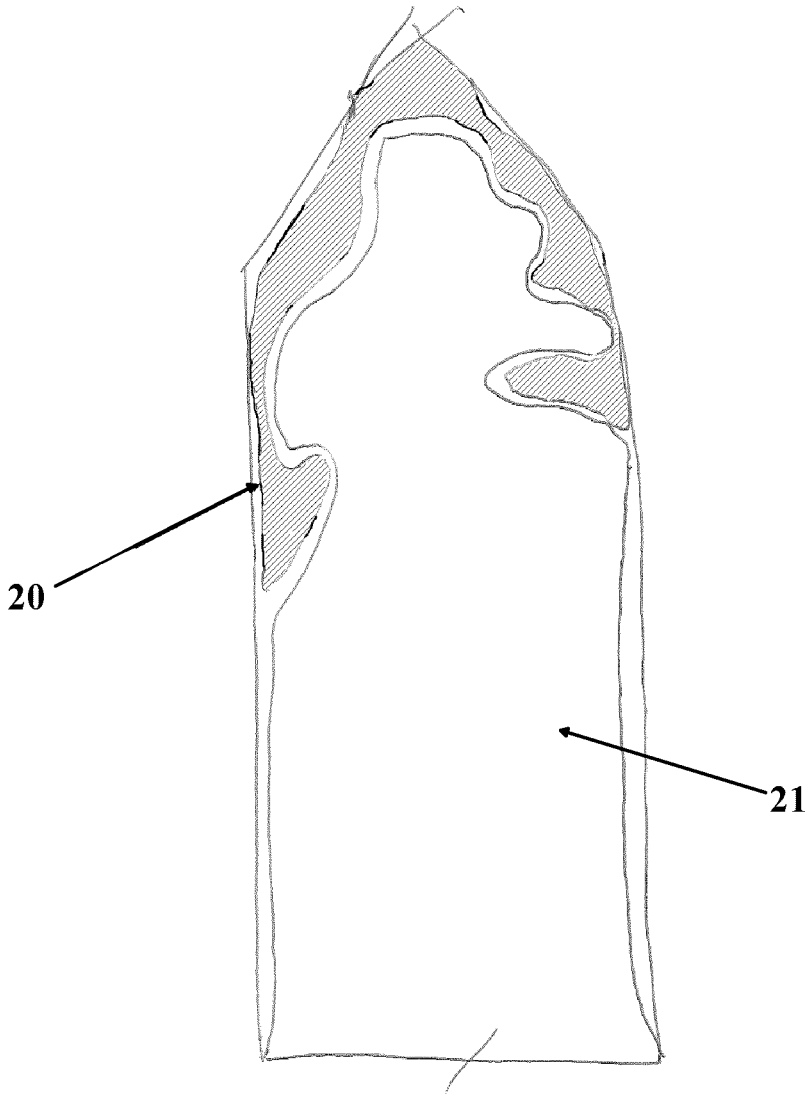
FIG. 3 shows a schematic of an embodiment that has bags that are too large.
Figures 4, 5:
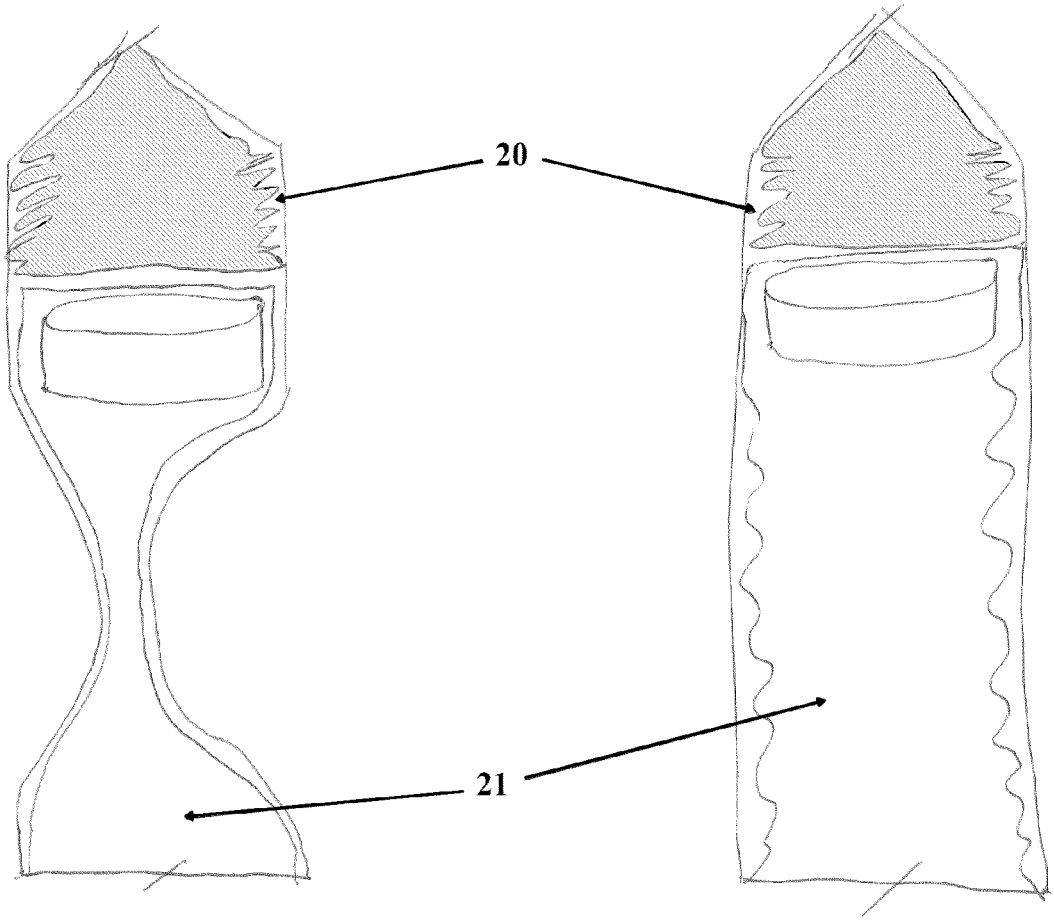
FIG. 4 shows a schematic of an embodiment with an expansion ring being squeezed and having bags that are too large.
FIG. 5 shows a schematic of the embodiment of FIG. 4 after release.

If the size, shape, material and/or thickness of the bag are not properly configured, it has been discovered that the friction between the airbag (2) and the walls of the body of the bottle (8) can inhibit the airbag (2) from expanding properly and can impede dispensing of the liquid from the liquid bag (1), as illustrated in FIG. 3. FIG. 3 is a schematic of how the function of the bags can be adversely impacted if one or more of the liquid bag (1) and the airbag (2) is too large. In the illustrated embodiment, contact position (20) shows where the walls of the body of the bottle (8) contact the liquid bag (1). Friction between the bags (1 or 2) and the walls of the body of the bottle (8) can reduce the likelihood of the bags (1 or 2) dispensing in a desired manner, as explained further below. In some embodiments, this friction can result in the air (21) inside the airbag (2) compressing rather than displacing the liquid bag (1), which results in decreased dispensing efficiency. FIG. 4 illustrates another embodiment of a bottle with an expansion ring, showing the air (21) being compressed as the bottle is squeezed. FIG. 5 illustrates a bottle after release, wherein the upper bag (1) has not displaced in a desired manner at least partly due to the friction at the contact position (20).

In other words, not just any bag design within an outer body will provide a desired operation. The bags should be large enough to limit slippage past or alongside one another and yet small enough to reduce to tolerable levels any friction of the bags with the sides of the body of the container. For example, if the bag is configured improperly, the bags can remain jammed against the walls of the body of the bottle (8) and the liquid cannot be properly squeezed out of the bottle. For example, if the upper bag (1) has too great a diameter, the bag (1) will experience too great of friction and will not fully dispense. On the other hand, if the lower bag (2) has too great a diameter, the bag (2) will experience too great of friction and full dispensing will be difficult due to the forces required during squeezing. Moreover, it is believed that improperly oversized bags will result in frictional forces that substantially preclude bag movement within the body of the bottle (8) while causing the air within the airbag (2) to simply compress instead. In another example, if the bags (1, 2) are sized too small compared to the body of the bottle (8), there may be a risk of the bags sliding past each other as the bottle is squeezed, impeding the dispensing of substantially all of the liquid.

Preferably, the bag or bags (1, 2) can be made of a substantially non-stretching material, such as for example but without limitation, aluminum foil, high density polyethylene plastics, or a plurality of different types of materials that are thin, airtight, strong and/or flexible. In some embodiments, the bag can be made of a material that has limited elasticity. For example but without limitation, the bag or bags can be made out of acetate, mylar or vinyl material in one configuration. The bag or bags (1, 2) preferably are strong enough to bear pressure without the support of the wall of the body of the bottle (8). In other words, the bags (1, 2) preferably are resistant to bursting under the pressures commonly encountered during dispensing. Bursting, tearing or otherwise compromising the integrity of one or both of the bags (1, 2) is believed to render the entire dispensing bottle generally ineffective.

Preferably, the shape of the bag of bags (1, 2) generally corresponds to the shape of an inside wall of the body of the bottle. For example, when the shape of the inner wall of the body of the bottle is circular in the region containing the bag, the bag preferably is substantially circular. However, in some embodiments, the shape of the bag can be different than the shape of the body of the bottle, but preferably the width of the bag is less than the corresponding width of the body of the bottle. For example, in some less preferred configurations, a circular bag can be used with a rectangular bottle body, wherein the diameter of the bag is less than the smallest width of the rectangular bottle body. In the descriptions herein, the bags (1, 2) are primarily described in their preferred embodiments as being generally cylindrical in shape. However, the disclosure should not be limited to cylindrical bags and the dimensions provided herein are understood to correspond to non-cylindrical bags as well. Moreover, the bags can have differing shapes from each other.

In some desirably functioning configurations, the outer cross dimension (e.g., outer diameter) of each of the bags (1, 2) is approximately 2% smaller than the correlating inner cross dimension (e.g., inner diameter) of the body of the bottle (8). In some embodiments, the outer cross dimension of the bags (1, 2) can be at least approximately 1% smaller than the inner cross dimension of the body of the bottle (8) and/or less than or equal to approximately 5% smaller than the inner cross dimension of the body of the bottle (8). In some embodiments, the outer cross dimension of the bags (1, 2) can be at least approximately 0.5% smaller than the inner cross dimension of the body of the bottle (8) and/or less than or equal to approximately 10% smaller than the inner cross dimension of the body of the bottle (8).

In another measurement of the working range of the size of the bags, the cross-sectional area taken of the volume formed by the outer surface of the bags (1, 2) when inflated is preferably approximately 4% smaller than the correlating cross-sectional area of the interior of the body of the bottle (8). In some embodiments, the cross-sectional area of the bags (1, 2) can be at least approximately 3% smaller than the cross-sectional area of the interior of the body of the bottle (8) and/or less than or equal to approximately 8% smaller than the cross-sectional area of the interior of the body of the bottle (8). In some embodiments, the cross-sectional area of the bags (1, 2) can be at least approximately 1% smaller than the cross-sectional area of the interior of the body of the bottle (8) and/or less than or equal to approximately 12% smaller than the cross-sectional area of the interior of the body of the bottle (8).

In yet another measurement of the working range of the size of the bags, the distance from the outer surface of the bags (1, 2) to the inner surface of the body of the bottle (8) is preferably approximately 0.5 mm. In some embodiments, the distance from the outer surface of the bags (1, 2) to the inner surface of the body of the bottle (8) can be at least approximately 0.25 mm and/or less than or equal to approximately 1.5 mm. In some embodiments, the distance from the outer surface of the bags (1, 2) to the inner surface of the body of the bottle (8) can be at least approximately 0.125 mm and/or less than or equal to approximately 5 mm.

The thickness of the bag material is preferably approximately 6 mils. One mil is equal to 1/1000 inch or 0.0254 millimeter. In some embodiments, the thickness of the bag material can be at least approximately 3 mils. In some embodiments, the thickness of the bag material can be at least approximately 2 mils and/or less than or equal to approximately 8 mils. In some embodiments, the thickness of the bag material is sufficient to reduce or eliminate the possibility of the bags sliding alongside each other (e.g., the material is sufficient resistant to deformation that the interface between the bags resists one sliding alongside the other).

Figure 6:
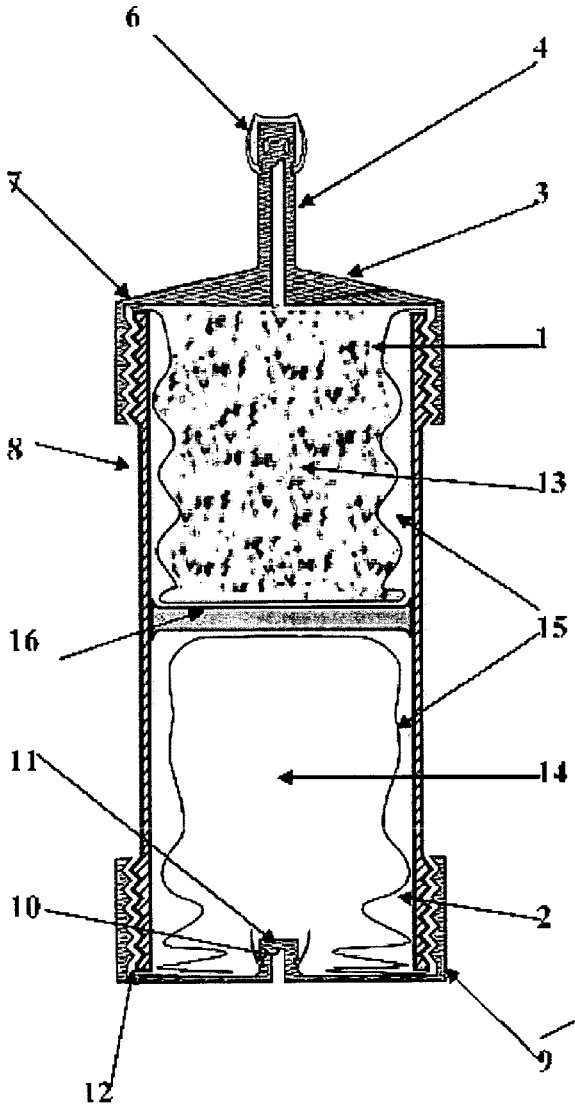
FIG. 6 shows an embodiment that has two bags with a separate plunger between them.
Figure 7:
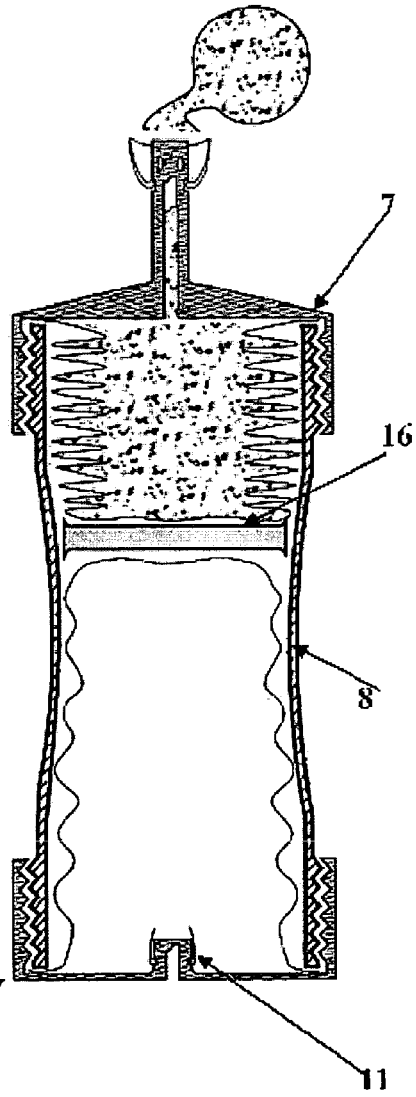
FIG. 7 shows an embodiment that has two bags with a separate plunger between them.

FIG. 6 shows an embodiment with a plastic plunger (16) disposed between the bags (1, 2). The operation of the valves (6, 11) in conjunction with the squeezing action on the body of the bottle (8) can be the same as the first embodiment. Having a loose plunger (16) disposed between the bags (1, 2) may be useful in that it may reduce the likelihood of one bag sliding at least partially alongside the other. The plunger (16) can be of a compressible or non-compressible material. FIG. 7 shows this same version being squeezed.

Figure 8:
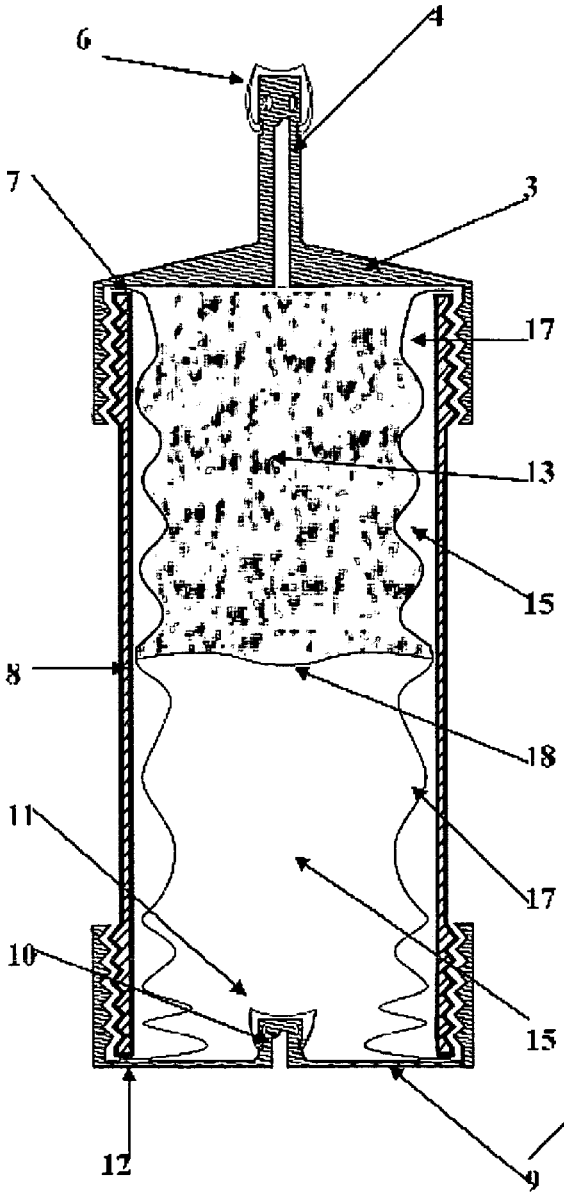
FIG. 8 shows an embodiment that has a single bag that is divided into two separate chambers by a dividing wall that is molded of one piece with the bags. The two chambers open outward to the two opposite ends.
Figure 9:
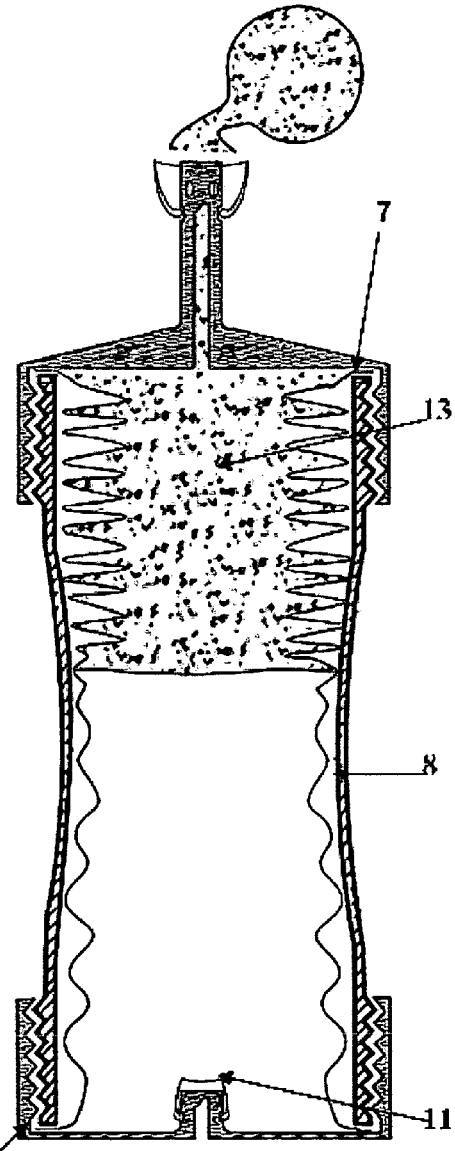
FIG. 9 shows this same embodiment being squeezed after some of the liquid has been dispensed.

FIG. 8 shows an embodiment using another type of bag (17). This type of bag (17) is sealed or joined in the middle (or at another intermediate portion) by a separating wall (18), while be open at the two opposed ends, thereby creating a separate upper chamber (13) and a separate lower chamber (14), along with a third chamber (15) disposed outside of the bag (17). In some configurations, two separate bags (1, 2) can be joined together in any suitable manner (e.g., gluing or the like). The upper chamber (13) of the bag (17) can be filled with the liquid, as per the other embodiments. The lip of the upper chamber (7) of the bag (17) can be sealed between the upper cap (3) and the body of the plastic bottle (8), as per the other embodiments. The lower chamber (14) can be formed by the bag (17), and can be sealed (12) between the lower cap (9) and the lower end of the body of the bottle (8) as per the other embodiments. The valves (6, 11) and squeezing action can work in the same way as the other embodiments. Because this two-chambered bag (17) is molded all of one piece, it is substantially less likely that the air chamber (14) will partly bypass or become tangled with the liquid chamber (13). FIG. 9 shows this same embodiment being squeezed.

Figure 10:
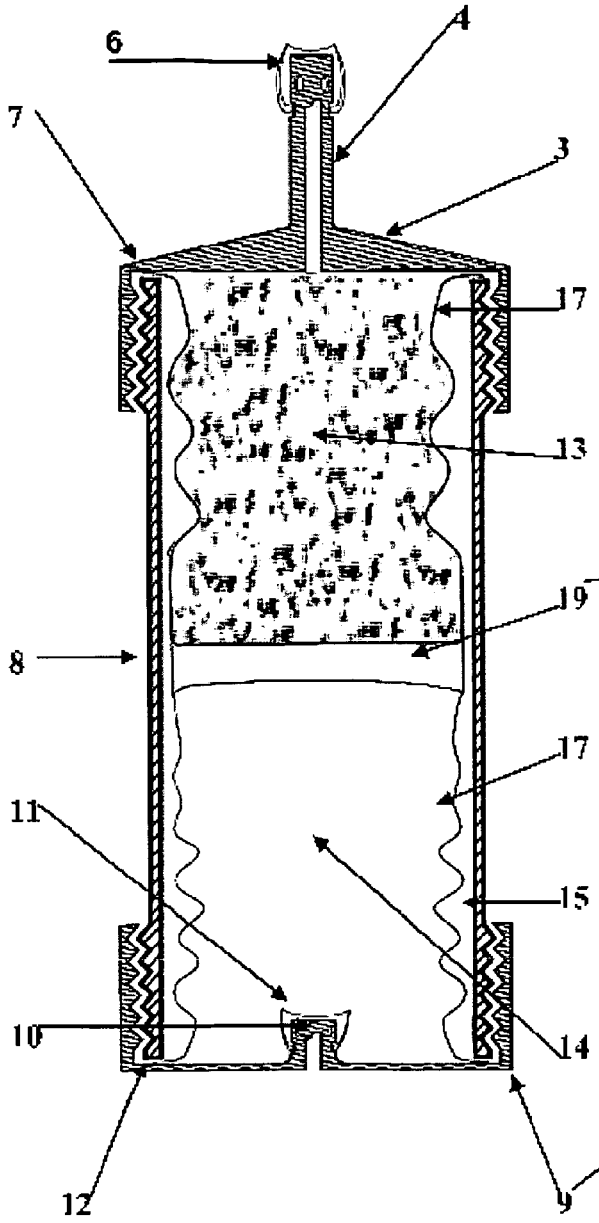
FIG. 10 shows an embodiment where the two chambers and a plunger are all one single molded piece.
Figure 11:
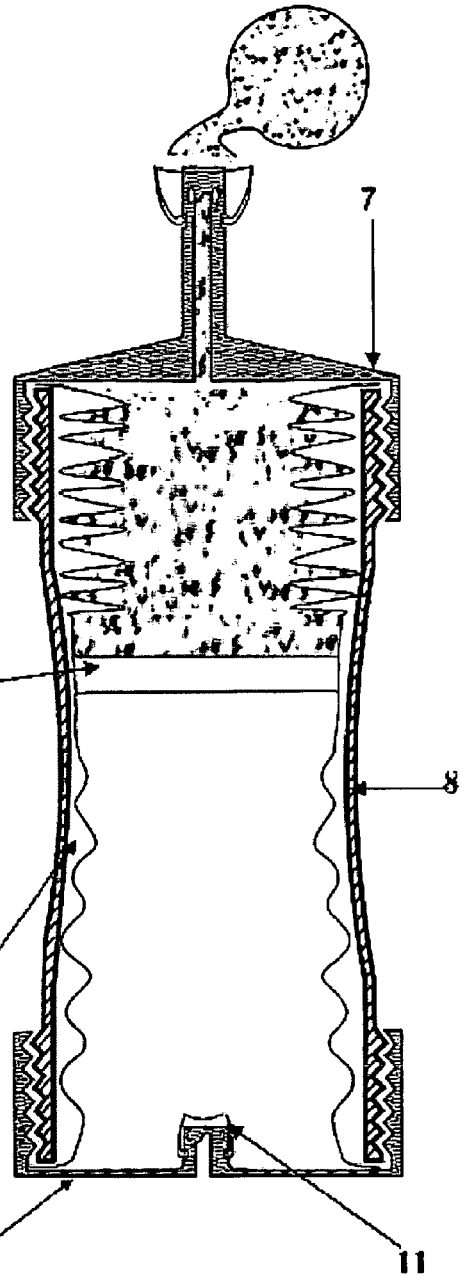
FIG. 11 shows this same embodiment being squeezed after some of the liquid has been dispensed.

FIG. 10 shows an embodiment using a minor variation of the two-chambered bag (17). In this embodiment, the dividing wall (19) between the two chambers can be made thicker; thick enough that it becomes a sort of plunger even though it is of one molded piece with the two-chambered bag itself The advantage of this embodiment is that with especially viscous materials the plunger (19) will reduce the likelihood of the two chambers (13, 14) bubbling into each other or deforming too much when the bottle is squeezed. The operation of the valves (6, 11) and the squeezing action is the same as per the other embodiments. FIG. 11 shows this same embodiment being squeezed.

Figure 12:
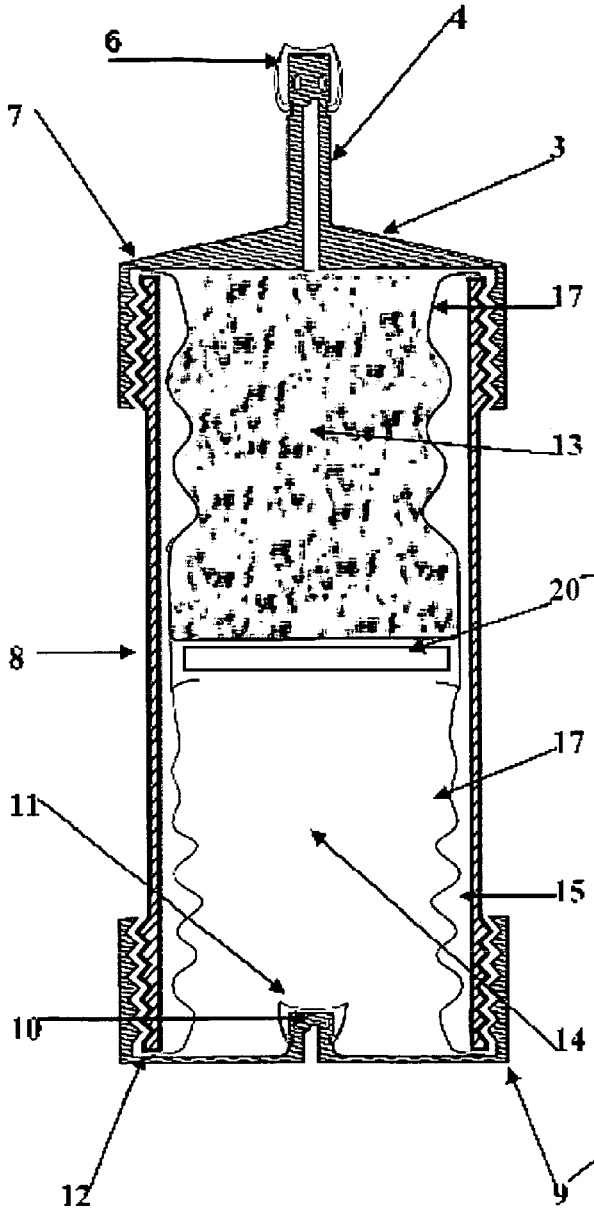
FIG. 12 shows an embodiment with an expansion ring.
Figure 13:
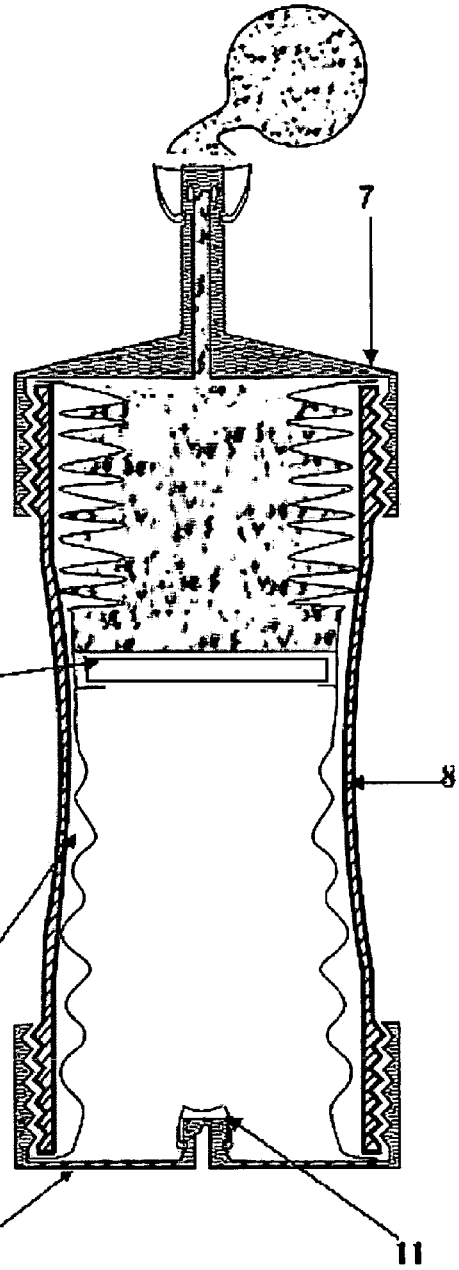
FIG. 13 shows this same embodiment being squeezed after some of the liquid has been dispensed.

FIG. 12 illustrates an embodiment of the bottle having an expansion ring (20) disposed near an interface of the top bag (1) and the airbag (2). FIG. 13 shows this same embodiment being squeezed. The expansion ring (20) can help reduce the likelihood of the top bag (1) sliding past or alongside the airbag (2), or vice versa. Furthermore, the expansion ring (20) can increase the likelihood of the interface between the bags remaining substantially perpendicular to the direction of the movement of the interface. The expansion ring (20) preferably is hollow at a top end and at a bottom end to help facilitate compressibility. In some embodiments, expansion ring (20) can be made of the same material as the body of the bottle. In other embodiments, the expansion ring (20) can be made of other resilient materials, such as rubber or spring steel.

In some embodiments, the expansion ring (20) can fit inside the top bag (1) or the airbag (2). In the illustrated embodiment, the expansion ring (20) is shown in the airbag (2). The diameter of the expansion ring (20) can be configured so as to reduce the likelihood of tearing of the airbag (2) when the bottle is squeezed directly at the portion of the bottle where the expansion ring (20) is positioned. Preferably, an outer diameter of the expansion ring (20) is approximately 2 mm less than am inner diameter of the body of the bottle (8). In some embodiments, the difference between the outer diameter of the expansion ring (20) and the inner diameter of the body of the bottle (8) can be at least approximately 1 mm and/or less than or equal to approximately 3 mm. In some embodiments, the difference between the outer diameter of the expansion ring (20) and the inner diameter of the body of the bottle (8) can be at least approximately 0.5 mm and/or less than or equal to approximately 5 mm.

Furthermore, to reduce the likelihood of tearing of the airbag (2), the expansion ring (20) preferably is not rigidly attached to the airbag (2). The expansion ring (20) can be loosely held in place and only attached to the airbag (2) in limited spots. For example but without limitation, in one configuration, the expansion ring (20) can be loosely held in place by slightly heat-sealing a portion of the airbag (2) just below the expansion ring (20). Preferably, the expansion ring (20) is only secured to the airbag (2), for example but without limitation by heat-sealing, in only one location. The expansion ring (20) being joined to the airbag (2) is shown in FIG. 12 and FIG. 13 by the short wall extending inwardly and positioned directly below the expansion ring (20).

The expansion ring (20) can be sufficiently thick so that the risk of the expansion ring (20) tilting or flipping within the airbag (2) is reduced or eliminated. Preferably, the expansion ring (2) is approximately 2 cm in thickness. In some embodiments, the thickness of the bag expansion ring can be at least approximately 1 cm and/or less than or equal to approximately 3 cm. In some embodiments, the thickness of the bag expansion ring can be at least approximately 0.5 cm and/or less than or equal to approximately 5 cm.

Figure 14:
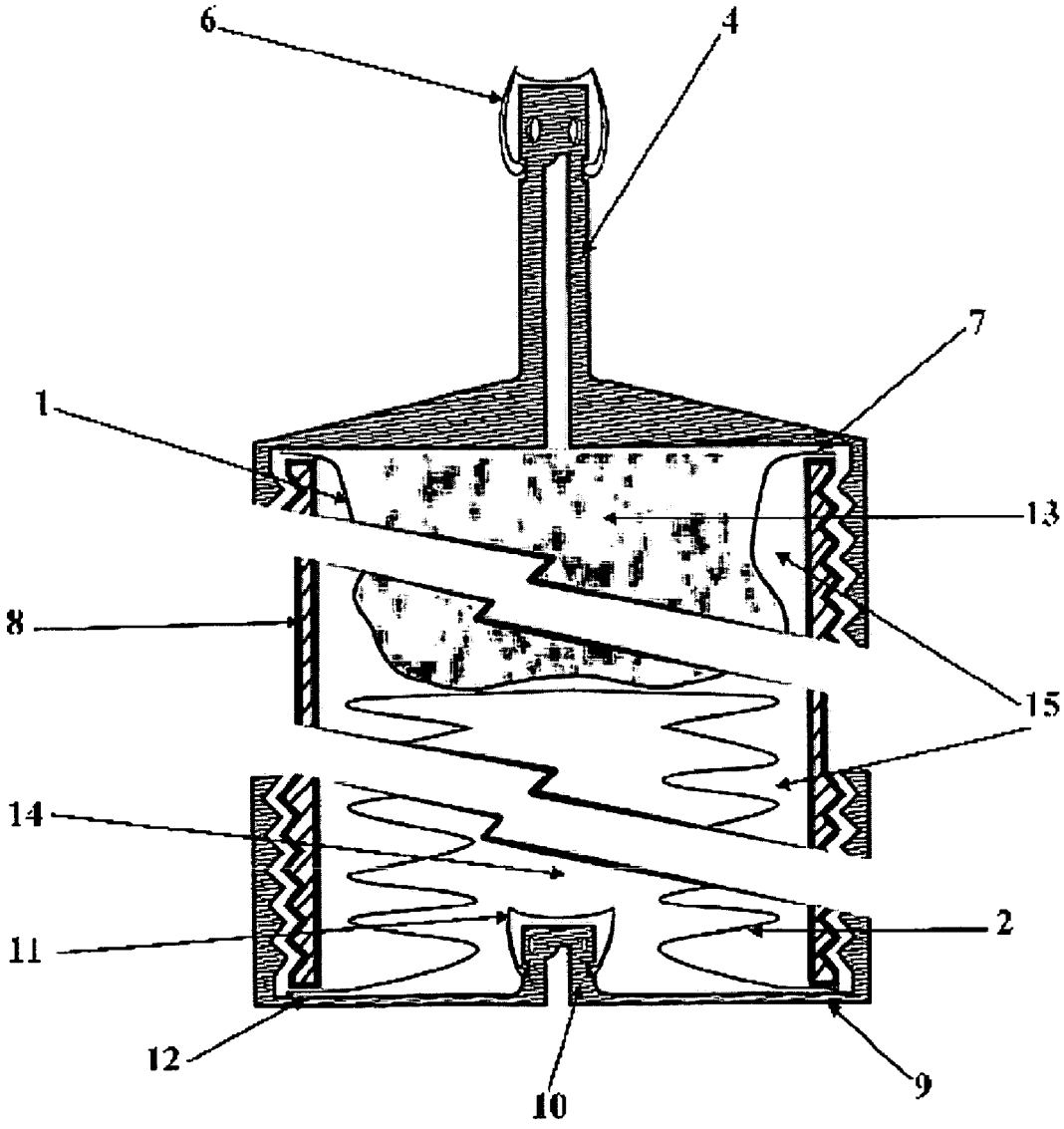
FIG. 14 shows a collapsed close up of the embodiment depicted in FIG. 1 and FIG. 2.

FIG. 14 shows a close-up of the first embodiment shown in FIGS. 1 and 2. In this view, it is more readily apparent that the lip (7) of the upper liquid bag (1) is sealed between the body of the plastic bottle (8) and the upper cap (3), while the lip (12) of the airbag (2 is sealed between the body of the plastic bottle (8) and the lower cap (9). The drawing shows the bottle after it has been squeezed and then released. Because of this, the upper valve (6) is sealed and no liquid is getting out through the top. At this time, the lower valve (11) is open and air is being sucked into the airbag (2).

Figures 15, 16:
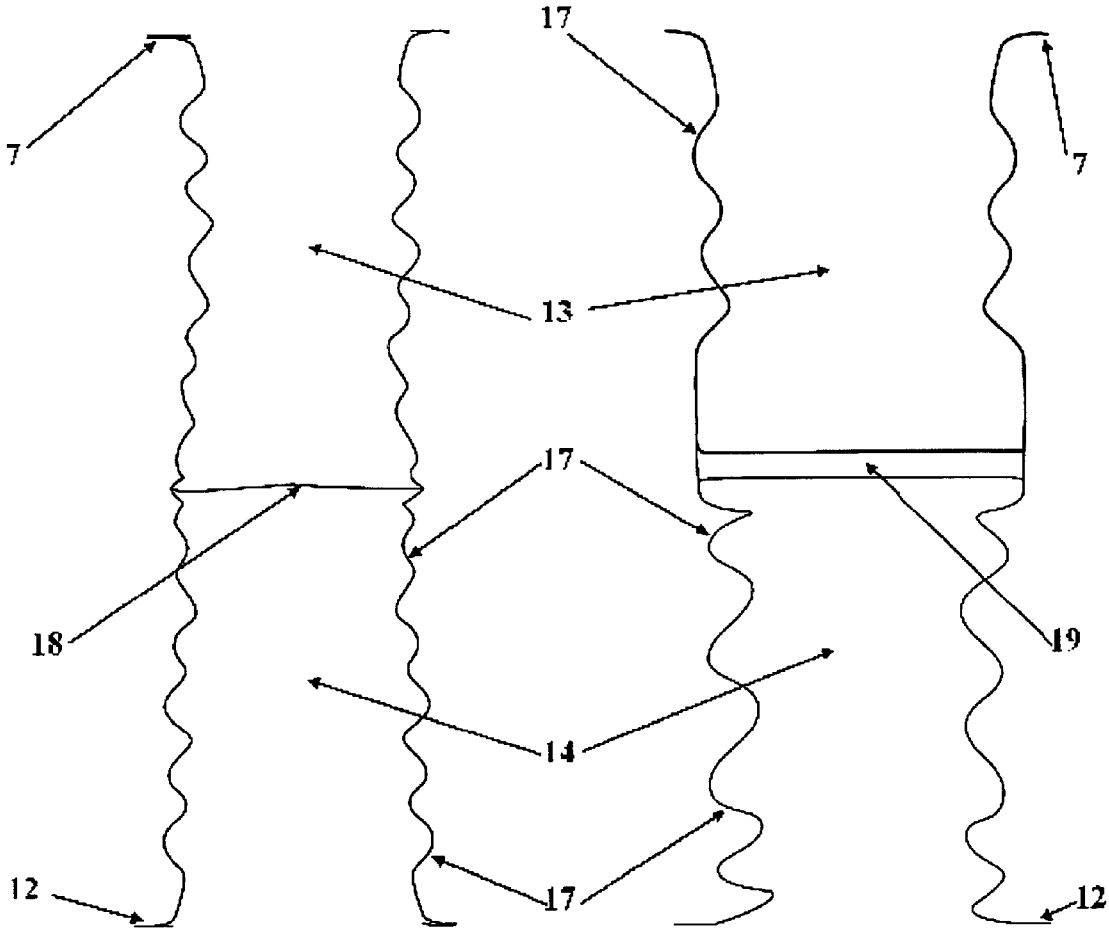
FIG. 15 shows the two-chambered bag depicted in FIG. 8 and FIG. 9. In this drawing the two-chambered bag is shown alone before it is put into the bottle.
FIG. 16 shows the two-chambered bag depicted in FIG. 10 and FIG. 11. This two chambered bag is molded of one piece with a plunger wall dividing the two chambers from each other. In this drawing the two-chambered bag is shown alone before it is put into the bottle.

FIG. 15 shows a two-chambered bag (17) only without the bottle. The upper chamber (13) can be filled with liquid; then the bag can be set into the body of the bottle. Then the caps can be put on the bottle in order to seal both ends of the two chambered bag. FIG. 16 shows a variation of the two-chambered bag wherein the dividing wall (19) is thick enough to be considered a sort of plunger even though it is of one molded piece with the walls of the two-chambered bag (17).

Although certain embodiments, features, and examples have been described herein, it will be understood by those skilled in the art that many aspects of the methods and devices illustrated and described in the present disclosure may be differently combined and/or modified to form still further embodiments. For example, it is contemplated that any component of the container illustrated and described above can be used alone or with other components. Additionally, it will be recognized that the methods described herein may be practiced in different sequences, and/or with additional devices as desired. Such alternative embodiments and/or uses of the methods and devices described above and obvious modifications and equivalents thereof are intended to be included within the scope of the present invention. Thus, the present invention is not limited to the described embodiments but can be modified in many different ways without departing from the scope of the appended claims.

What is claimed is:

1. A container for dispensing products of varying viscosity, the container comprising:

a flexible body defining a cavity;

a first cap coupled to a first end of the flexible body, the first cap comprising a first one-way valve configured to automatically open during use of the container to allow the product to exit from the cavity defined by the body and automatically close during use to substantially obstruct fluid and/or air from entering the cavity defined by the body;

a second cap coupled to a second end of the body, the second cap comprising a second one-way valve configured to automatically open during use of the container to allow fluid and/or air to enter into the cavity defined by the body and automatically close during use to substantially obstruct fluid and/or air from exiting the cavity defined by the body;

a first chamber positioned within the cavity defined by the body, the first chamber formed by a first flexible material having an outer diameter being smaller than an inner diameter of the flexible body, the first chamber enclosed in part by the first cap;

a second chamber positioned within the cavity defined by the body, the second chamber formed by a second flexible material having an outer diameter being smaller than the inner diameter of the flexible body, the second chamber enclosed in part by the second cap; and a third chamber positioned within the cavity defined by the body, the third chamber defined by an inside surface of the flexible body, an outside surface of the first chamber and an outside surface of the second chamber;

wherein a decrease in volume of the first chamber results in an inlet of air into the second chamber, which causes inflation of the second chamber when the flexible body recovers to a first shape after having been compressed to a second shape.

2. The container of claim 1, wherein the first flexible material and the second flexible material each comprise a base and an opening opposite the base, the base of the first flexible material attached to the base of the second flexible material.

3. The container of claim 1 further comprising an interface region disposed between the first chamber and the second chamber.

4. The container of claim 1 further comprising a plunger disposed between the first chamber and the second chamber.

5. The container of claim 1 further comprising a compressible expansion ring disposed adjacent an interface between the first chamber and the second chamber and positioned within at least one of the first chamber or the second chamber.

6. The container of claim 1, wherein the first flexible material and the second flexible material are inelastic.

7. The container of claim 1, wherein an outer cross-dimension of the first flexible material and an outer cross-dimension of the second flexible material is approximately 2% smaller than an inner cross-dimension of a region of the body of the container containing the first flexible material and the second flexible material.

8. The container of claim 1, wherein an outer cross-dimension of the first flexible material and an outer cross-dimension of the second flexible material range from at least approximately 1% to less than or equal to approximately 5% smaller than the inner cross-dimension of a region of the body of the container containing the first flexible material and the second flexible material.

9. The container of claim 1, wherein a shortest distance from an outer surface of the first flexible material or the second flexible material to an inner surface of the body of the container is approximately 0.5 mm.

10. The container of claim 1, wherein a shortest distance from an outer surface of the first flexible material or the second flexible material to an inner surface of the body of the container ranges from at least approximately 0.25 mm and/or less than or equal to approximately 1.5 mm.

11. The container of claim 1, wherein a thickness of at least one of the first flexible material and the second flexible material is approximately 6 mils.

12. The container of claim 1, wherein a thickness of at least one of the first flexible material and the second flexible material ranges from at least approximately 2 mils and/or less than or equal to approximately 8 mils.

13. The container of claim 1, wherein an interface between the first chamber and the second chamber is generally along a plane that is substantially normal to a longitudinal axis of the body.

14. The container of claim 1, wherein the second flexible material impedes movement of the first flexible material in a longitudinal direction of the body.

15. The container of claim 1, wherein the first flexible material comprises an opening having a rim, the rim of the opening disposed between the body and the first cap.

16. The container of claim 1, wherein the second flexible material comprises an opening having a rim, the rim of the opening disposed between the body and the second cap.

17. The container of claim 1, wherein the product directly contacts the first flexible material.

18. The container of claim 1, wherein the third chamber is hermetically sealed.

19. The container of claim 1, wherein the first one-way valve is disposed outside of the first chamber.

20. The container of claim 19, wherein the first cap comprises a tube that fluidly connects the first chamber with the first one-way valve.

* * * * *

UNITED STATES PATENT AND TRADEMARK OFFICE

CERTIFICATE OF CORRECTION

PATENT NO. : 8,408,426 B2
APPLICATION NO. : 13/330484
DATED : April 2, 2013
INVENTOR(S) : Joseph Wadih Bakhos It is certified that error appears in the above-identified patent and that said Letters Patent is hereby corrected as shown below:

In the Specification

At Column 7, Line 22, please change "itself" to --itself.--

Signed and Sealed this
Sixth Day of May, 2014

Michelle K. Lee

Michelle K. Lee
*Deputy Director of the United States Patent and Trademark Office*